US008955467B1

(12) United States Patent
Horne

(10) Patent No.: US 8,955,467 B1
(45) Date of Patent: Feb. 17, 2015

(54) STEAM BOILER

(71) Applicant: William Parrish Horne, Matthews, NC (US)

(72) Inventor: William Parrish Horne, Matthews, NC (US)

( * ) Notice: Subject to any disclaimer, the term of this patent is extended or adjusted under 35 U.S.C. 154(b) by 32 days.

(21) Appl. No.: 13/736,155

(22) Filed: Jan. 8, 2013

(51) Int. Cl.

| | |
|---|---|
| ***F22B 7/12*** | (2006.01) |
| ***F22B 5/00*** | (2006.01) |
| ***F22B 21/26*** | (2006.01) |
| ***F22B 27/08*** | (2006.01) |
| ***F22B 37/26*** | (2006.01) |
| ***F22G 1/02*** | (2006.01) |
| ***F22G 1/06*** | (2006.01) |
| ***F22G 7/14*** | (2006.01) |
| ***F23D 14/46*** | (2006.01) |
| ***F23D 14/82*** | (2006.01) |

(52) U.S. Cl.
CPC .. *F22B 7/12* (2013.01); *F22B 21/26* (2013.01)
USPC ..... 122/182.2; 122/235.23; 122/14.31; 122/15.1; 122/110; 122/111; 122/476; 122/489; 122/31.1; 122/459; 122/250 R; 122/18.4; 122/487; 126/344; 126/348; 126/361.1; 126/5; 237/41; 431/2; 431/350; 431/246; 431/164; 431/210

(58) Field of Classification Search
None
See application file for complete search history.

(56) References Cited

U.S. PATENT DOCUMENTS

| | | | | | |
|---|---|---|---|---|---|
| 14,414 | A | * | 3/1856 | Shaw | 239/430 |
| 1,382,204 | A | * | 6/1921 | Lewis | 122/14.1 |
| 1,852,382 | A | * | 4/1932 | Wagle | 122/169 |
| 1,895,790 | A | * | 1/1933 | Eule | 122/250 R |
| 1,959,788 | A | * | 5/1934 | Hunkele | 122/165 |
| 1,991,572 | A | * | 2/1935 | Pangborn | 122/448.4 |
| 2,621,635 | A | * | 12/1952 | Joosten | 122/250 R |
| 2,645,210 | A | * | 7/1953 | Harris et al. | 122/248 |
| 2,718,217 | A | * | 9/1955 | Walter, Jr. | 122/250 R |
| 3,128,756 | A | * | 4/1964 | Galvin | 126/116 R |
| 3,352,289 | A | * | 11/1967 | Cunningham, Jr. et al. | 122/240.1 |
| 3,456,620 | A | * | 7/1969 | Phillips, Jr. | 122/32 |
| 3,460,895 | A | * | 8/1969 | Keizo | 431/116 |
| 3,598,090 | A | * | 8/1971 | Smith | 122/250 R |
| 3,811,414 | A | * | 5/1974 | Minton | 122/250 R |
| 3,881,962 | A | * | 5/1975 | Rubinstein | 136/209 |
| 4,007,712 | A | * | 2/1977 | Finger et al. | 122/250 R |
| 4,291,649 | A | * | 9/1981 | Boder | 122/136 R |
| 4,461,345 | A | * | 7/1984 | Vandervaart | 165/113 |
| 4,502,626 | A | * | 3/1985 | Gerstmann et al. | 122/44.2 |
| 4,641,631 | A | * | 2/1987 | Jatana | 126/101 |
| 4,644,906 | A | * | 2/1987 | Garabedian et al. | 122/32 |
| 4,737,337 | A | * | 4/1988 | Garabedian et al. | 376/299 |
| 4,768,495 | A | * | 9/1988 | Zifferer | 126/101 |
| 4,798,240 | A | * | 1/1989 | Gerstmann et al. | 165/48.1 |
| 5,259,342 | A | * | 11/1993 | Brady et al. | 122/367.1 |
| 5,339,654 | A | * | 8/1994 | Cook et al. | 62/476 |
| 5,433,174 | A | * | 7/1995 | Brady et al. | 122/367.1 |
| 5,533,362 | A | * | 7/1996 | Cook et al. | 62/476 |
| 5,546,760 | A | * | 8/1996 | Cook et al. | 62/497 |
| 5,638,773 | A | * | 6/1997 | Brady et al. | 122/248 |
| 5,687,678 | A | * | 11/1997 | Suchomel et al. | 122/250 R |

(Continued)

*Primary Examiner* — Gregory Huson
*Assistant Examiner* — Eric Gorman
(74) *Attorney, Agent, or Firm* — Ted Masters

(57) ABSTRACT

A steam boiler includes a boiler housing. A helical coil for boiling water and superheating the wet steam is disposed within the boiler housing. A burner emits combustion gases which heat a heat emitter which is disposed in the inner space of the helical coil. Combustion gases from the burner enter the internal cavity of the heat emitter and then pass through perforations in the heat emitter before contacting the helical coil. As such, the heat emitter is heated by the combustion gases and serves as a radiant heat source for the helical coil.

10 Claims, 5 Drawing Sheets

(56) References Cited

U.S. PATENT DOCUMENTS

| | | | | |
|---|---|---|---|---|
| 5,902,524 | A * | 5/1999 | Wootten | 264/29.1 |
| 5,964,985 | A * | 10/1999 | Wootten | 201/40 |
| 6,013,158 | A * | 1/2000 | Wootten | 202/99 |
| 6,334,411 | B1 * | 1/2002 | Lesage et al. | 122/18.1 |
| 6,419,480 | B2 * | 7/2002 | Al-Halbouni | 431/351 |
| 6,641,625 | B1 * | 11/2003 | Clawson et al. | 48/127.9 |
| 6,986,797 | B1 * | 1/2006 | Clawson et al. | 48/102 A |
| 7,066,973 | B1 * | 6/2006 | Bentley et al. | 48/197 R |
| 7,836,856 | B2 * | 11/2010 | Mullen et al. | 122/155.2 |
| 8,372,248 | B1 * | 2/2013 | Sherry | 202/160 |
| 2003/0097710 | A1 * | 5/2003 | Adrian | 4/598 |
| 2004/0007879 | A1 * | 1/2004 | Ruggieri et al. | 290/52 |
| 2004/0013988 | A1 | 1/2004 | Kim | |
| 2004/0216460 | A1 * | 11/2004 | Ruggieri et al. | 60/670 |
| 2006/0045828 | A1 * | 3/2006 | Aaron et al. | 422/196 |
| 2006/0186669 | A1 * | 8/2006 | Ruggieri et al. | 290/2 |
| 2007/0209606 | A1 * | 9/2007 | Hamada et al. | 122/18.1 |
| 2009/0151653 | A1 * | 6/2009 | Mullen et al. | 122/18.3 |
| 2011/0180024 | A1 * | 7/2011 | Horne | 122/476 |

* cited by examiner

STEAM BOILER

CROSS REFERENCE TO RELATED APPLICATION

None

TECHNICAL FIELD

The present invention pertains generally to steam boilers, and more particularly to a steam boiler which includes a heat emitter which improves the efficiency of the steam boiler.

BACKGROUND OF THE INVENTION

Steam boilers are well known in the art. These devices develop steam by applying heat to water. The steam is used to drive a load such as a steam engine. Particularly in this day of energy conservation, it is important to maximize the efficiency of the steam generation process.

BRIEF SUMMARY OF THE INVENTION

The present invention is directed to a steam boiler which utilizes a heat emitter to increase boiler efficiency. The heat emitter intercepts the combustion gases directly from a burner, and converts the heat in the combustion gases into radiant heat which in turn heats a boiler coil. The heat emitter has a plurality of perforations which pass the combustion gases from the burner to the boiler coil. The heat emitter can be utilized with both commercially available burners and special purpose burners, and in one embodiment can be fabricated from stainless steel.

In accordance with an embodiment, a steam boiler includes a boiler housing. A helical coil is disposed within the boiler housing, the helical coil has a feedwater input end and an opposite steam output end, the helical coil defines an inner space. A burner emits combustion gases into said boiler housing, and a feedwater pump supplies feedwater to the helical coil. A heat emitter has a plurality of perforations and an internal cavity, the heat emitter is disposed within the inner space of the helical coil and adjacent to the burner so that the combustion gases are received by the internal cavity and pass though the plurality of perforations before contacting the helical coil.

In accordance with another embodiment, the heat emitter has a conical shape.

In accordance with another embodiment, the conical shape has a truncated end. A plug is disposed at the truncated end.

In accordance with another embodiment, the heat emitter has a surface. The plurality of perforations are substantially evenly distributed on the surface of the heat emitter.

In accordance with another embodiment, the internal cavity is vacant.

In accordance with another embodiment, the helical coil has a first length. The heat emitter has a second length which is greater than the first length of the helical coil.

In accordance with another embodiment, the helical coil includes a plurality of coil segments. The plurality of coil segments include a first group of coil segments disposed near the feedwater input end, and a second group of coil segments disposed near the steam output end. The first group of coil segments is tightly wound so that they block passage of the combustion gases, and the second set of coil segments is loosely wound so that they facilitate passage of the combustion gases.

Other embodiments, in addition to the embodiments enumerated above, will become apparent from the following detailed description, taken in conjunction with the accompanying drawings, which illustrate, by way of example, the principles of the steam boiler.

DETAILED DESCRIPTION OF THE INVENTION

Figure 1:
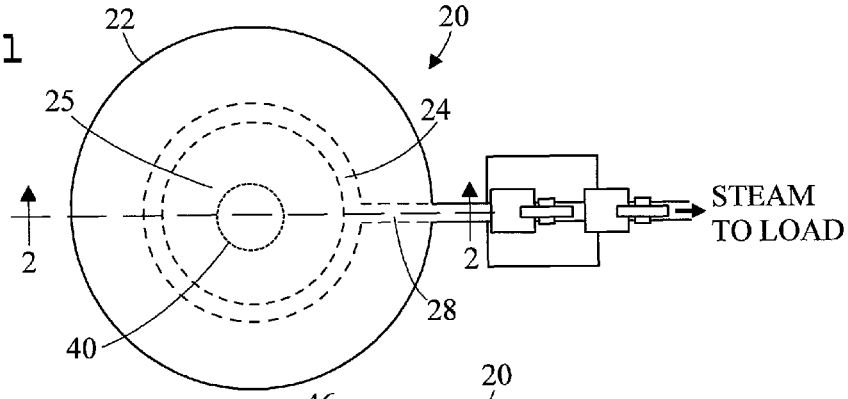
FIG. 1 is a top plan view of a steam boiler.
Figure 2:
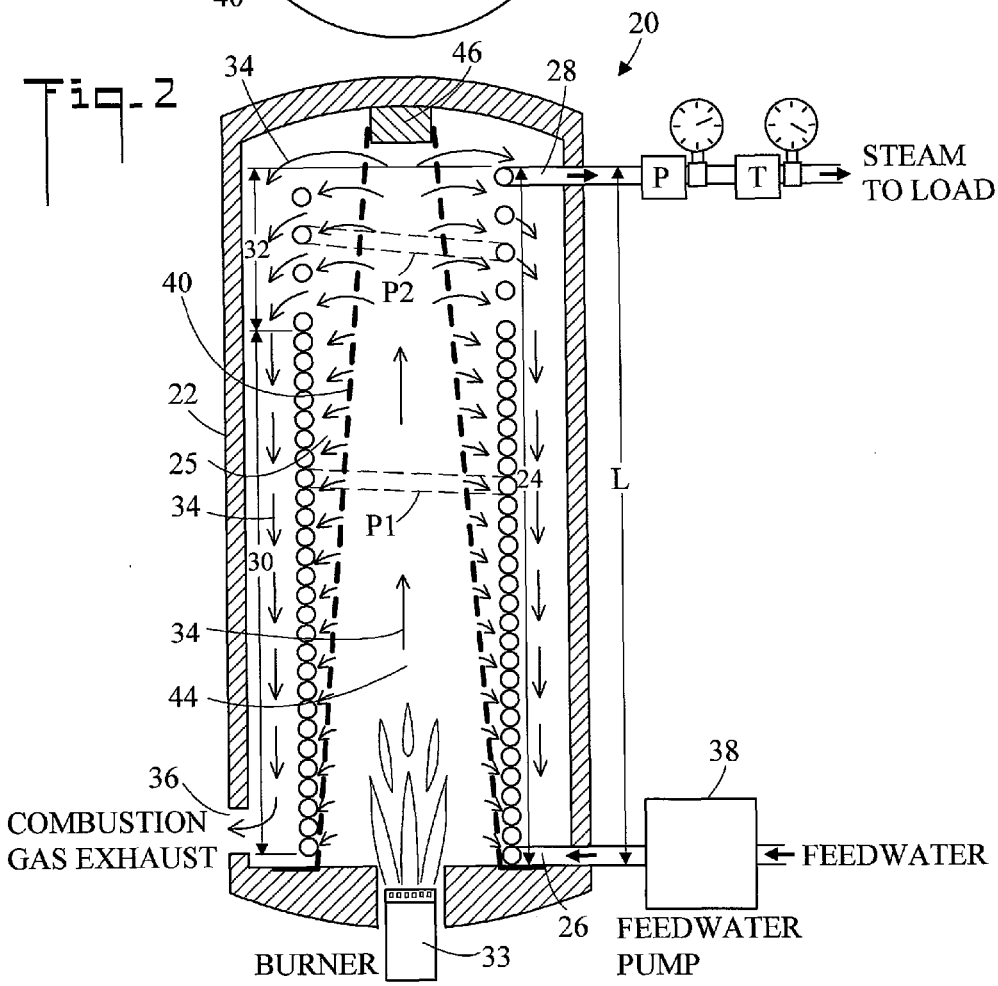
FIG. 2 is a cross sectional view along the line 2-2 of FIG. 1.

Referring initially to FIGS. 1 and 2, there are illustrated top plan and cross sectional view respectively of a steam boiler generally designated as 20. Steam boiler 20 includes a hollow boiler housing 22 which in the shown embodiment is insulated on the outside. A hollow helical coil 24 for boiling water is disposed within boiler housing 22. Helical coil 24 converts the water into wet steam and then superheats the wet steam to create dry steam. In the shown embodiment helical coil 24 is wound in the shape of a cylinder which defines an empty inner space 25 (also refer to FIG. 6). Helical coil 24 has a feedwater input end 26 and an opposite steam output end 28. In FIG. 2 boiler housing 22 and helical coil 24 are oriented vertically with the longitudinal axis of boiler housing 22 aligned (colinear) with the longitudinal axis of helical coil 24. However, horizontal orientation is also possible (refer to FIG. 7 and the associated discussion).

Helical coil 24 includes a plurality of coil segments 23 (also refer to FIG. 3), wherein a coil segment 23 is defined as a single loop of coil which subtends 360°. As shown in FIG. 2, helical coil 24 has about thirty coil segments 23. The plurality of coil segments 23 include a first group of coil segments 30 disposed near feedwater input end 26, and a second group of coil segments 32 disposed near steam output end 28. First group of coil segments 30 are tightly wound (abutting) so that they block passage of combustion gases 34. Second group of coil segments 32 are loosely wound (spaced apart) so that they facilitate passage of combustion gases 34, thereby providing heating to the outside of helical coil 24 as combustion gases 34 are routed to combustion gas exhaust port 36. The winding of helical coil 24 is analogous to a threaded screw wherein first group of coil segments 30 has a pitch P1 and second group of coil segments has a greater pitch P2 (more angled with the central axis). Helical coil 24 has a first length L.

Steam boiler 20 further includes a burner 33 which emits combustion gases 34 into boiler housing 22. In the shown embodiment, burner 33 is disposed near feedwater input end 26 of helical coil 24. The combustion gases 34 circulate within boiler housing 22 as is shown by the numerous circulation arrows, and exit at combustion gas exhaust port 36. Steam boiler 20 further includes a feedwater pump 38 for supplying feedwater to helical coil 24 at feedwater input end 26.

Figure 4:
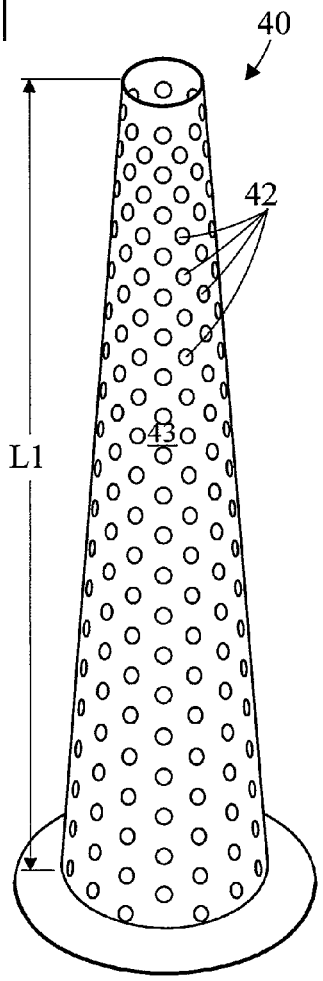
FIG. 4 is a perspective view of a heat emitter.
Figure 5:
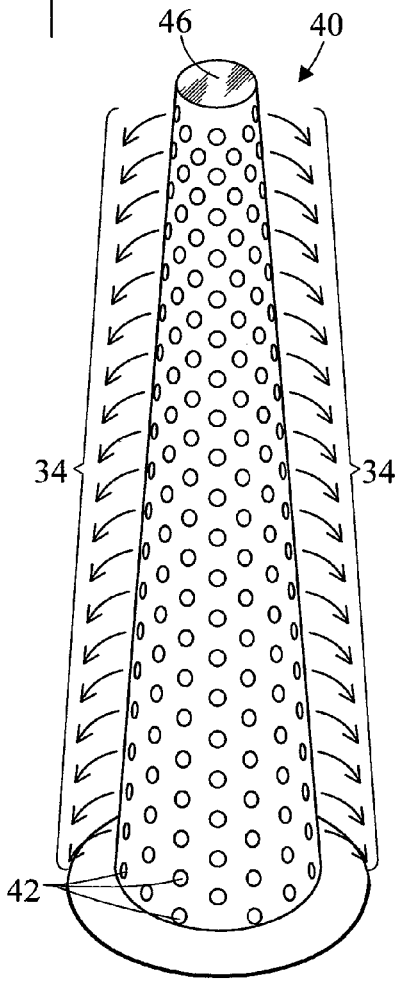
FIG. 5 is a perspective view of a second embodiment of the heat emitter.

Steam boiler 20 further includes a heat emitter 40 which has a plurality of perforations (holes) 42 and an internal cavity 44 (also refer to FIGS. 4 and 5 and the associated discussion). Heat emitter 40 is disposed within inner space of helical coil 24 and adjacent to burner 33 (at feedwater input end 26 of helical coil 24), so that combustion gases 34 are received by internal cavity 44 and pass though the plurality of perforations 42 before contacting helical coil 24. Heat emitter 40 is heated by combustion gases 34, and radiates that heat to helical coil 24 thereby increasing the heat efficiency of steam boiler 20. It is noted that heat emitter 40 is also heated by radiant heat from burner 33. It is also noted that internal cavity 44 of heat emitter 40 is vacant (i.e. has no structure to impede the flow of combustion gases 34 from burner 33). Also it is noted that the end of heat emitter 40 opposite burner 33 is closed. By closing the end of heat emitter 40 which is opposite burner 33, combustion gases 34 are forced to go through perforations 42 (as opposed to escaping out the top of heat emitter 40). In the shown embodiment a plug 46 which is part of boiler housing 22 blocks the end of heat emitter 40, thereby forcing combustion gases 34 outward toward helical coil 24. In an embodiment plug 46 is insulated. FIG. 2 also shows a pressure switch P which is utilized to control steam boiler operation, and a temperature switch T which will shut steam boiler 20 down if a malfunction such as a leak or feedwater pump failure occurs and creates excessive temperature. Helical coil 24 is primarily heated by radiant heat from heat emitter 40, but is also heated by the combustion gases 34 from burner 33 which flow through the perforations 42 in heat emitter 40. Heat from these two sources causes the feedwater to boil within helical coil 24 and produce steam which exits at steam output end 28. In an embodiment, the steam in second group of coil segments 32 is superheated.

Figure 3:
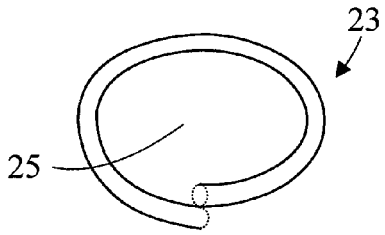
FIG. 3 is a perspective view of a coil segment.
Figure 6:
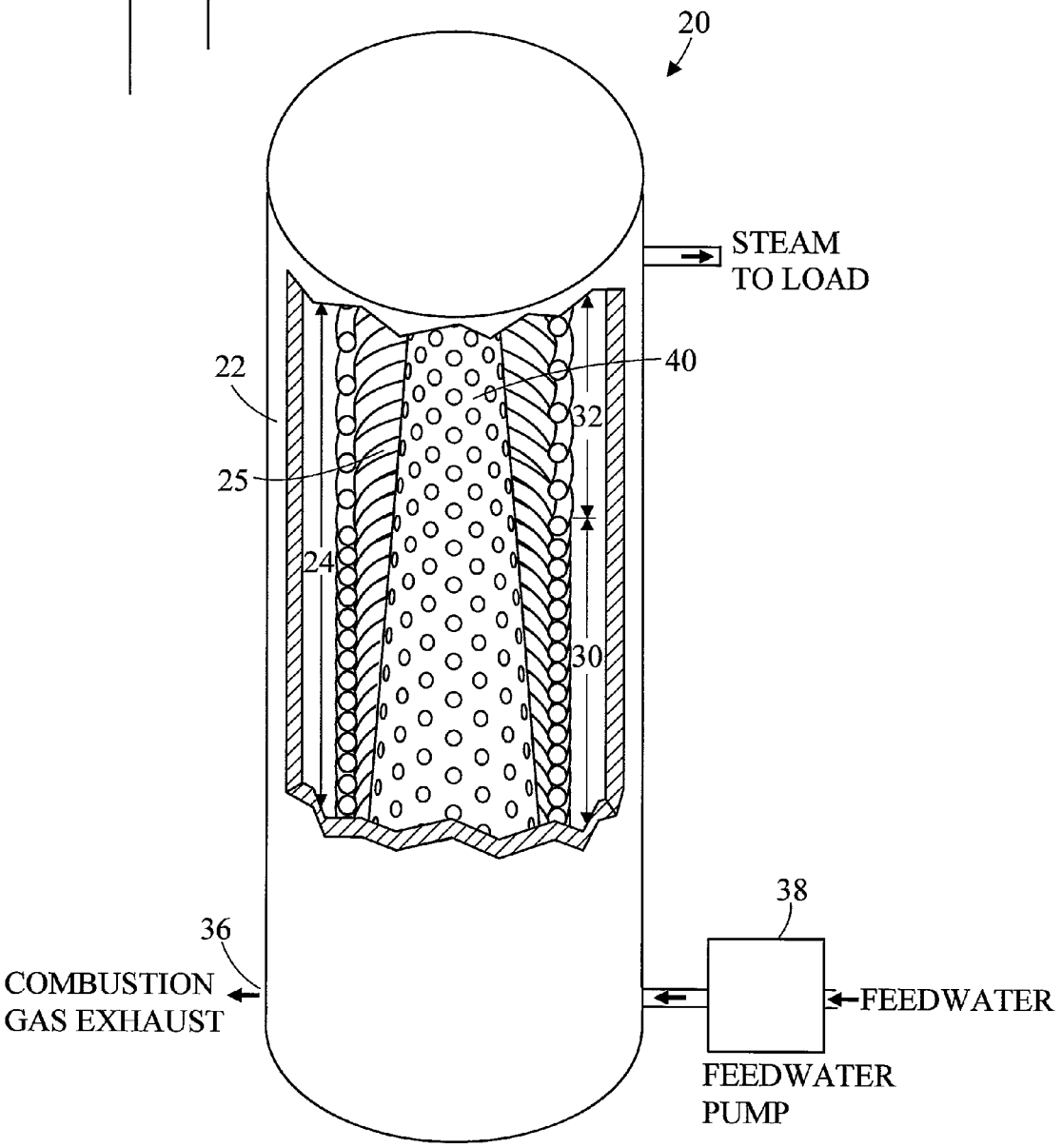
FIG. 6 is a cutaway perspective view of the steam boiler.

FIG. 3 is a perspective view of one coil segment 23 of helical coil 24 showing inner space 25 (also refer to FIGS. 2 and 6).

FIG. 4 is a perspective view of heat emitter 40 showing plurality of perforations 42. In the shown embodiment, heat emitter 40 has a surface 43. The plurality of perforations 42 are substantially evenly distributed on surface 43 of heat emitter 40. That is, the plurality of perforations 42 can cover the entire surface 43 of heat emitter 40. Also heat emitter 40 has a hollow conical shape which includes the shown frustoconical shape, and has a second length L1 which is greater than first length L of helical coil 24 (refer to FIG. 2). Depending upon the specific application, in various embodiments heat emitter 40 can be fabricated from 16 gauge to 26 gauge stainless steel, however other materials or gauges can also be used.

The conical shape can be either frustoconical as shown, or closed or pointed with a closed end. In an embodiment, second length L1 is about five feet.

FIG. 5 is a perspective view of a second embodiment of heat emitter 40. In this embodiment, conical shaped heat emitter 40 has a truncated end (top as shown). An unperforated plug 46 is disposed at the truncated end. Plug 46 prevents combustion gases 34 from exiting the truncated end, and forces combustion gases 34 through perforations 42.

FIG. 6 is a cutaway perspective view of steam boiler 20, showing boiler housing 22, coil segments 24, helical coil 24, first group of coil segments 30, second group of coil segments 32, combustion gas exhaust 36, feed water pump 38, and heat emitter 40.

Figure 7:
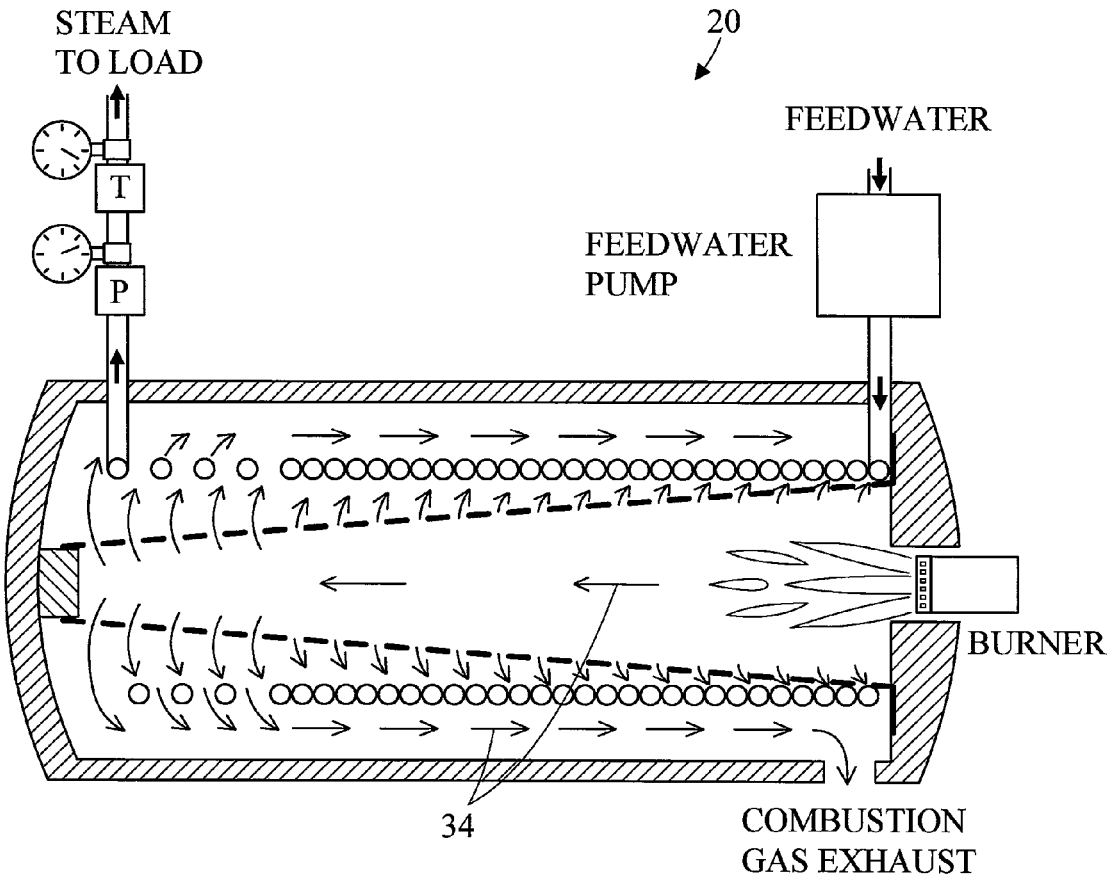
FIG. 7 is a cross sectional view of the steam boiler in a horizontal position.

FIG. 7 is a cross sectional view of steam boiler 20 in a horizontal position. A horizontal boiler position results in a lower center of gravity and better servicing access. Combustion gases 34 exit at the bottom for better efficiency.

Figure 8:
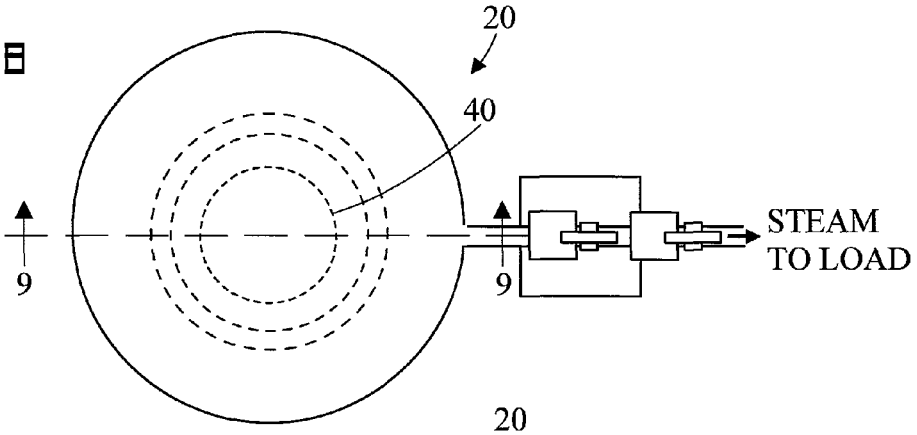
FIG. 8 is a top plan view of a second embodiment steam boiler.
Figure 9:
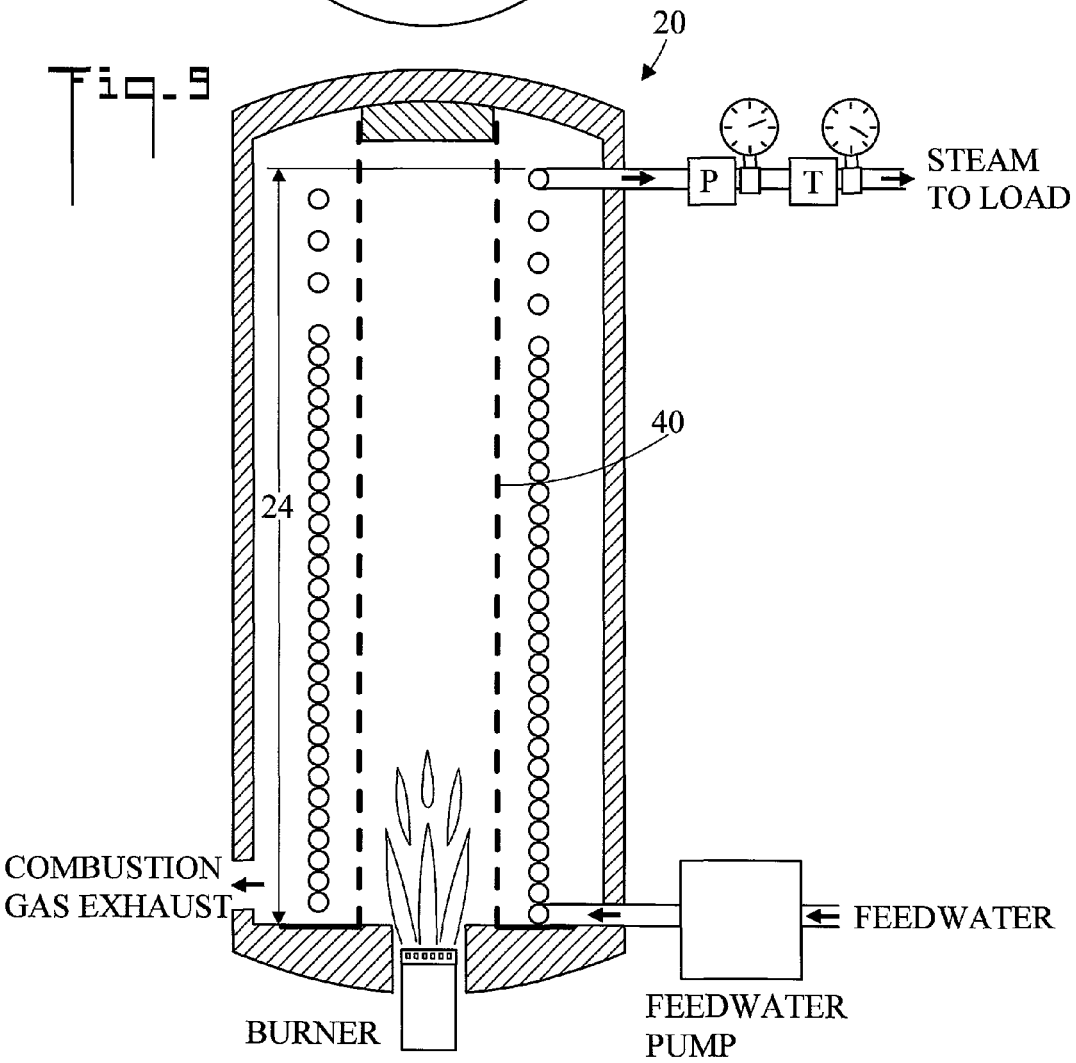
FIG. 9 is a cross sectional view along the line 9-9 of FIG. 8.

FIGS. 8 and 9 are top plan and cross sectional views respectively of a second embodiment steam boiler 20. In this embodiment, heat emitter 40 is cylindrical rather than conical.

The embodiments of the steam boiler described herein are exemplary and numerous modifications, combinations, variations, and rearrangements can be readily envisioned to achieve an equivalent result, all of which are intended to be embraced within the scope of the appended claims. Further, nothing in the above-provided discussions of the steam boiler should be construed as limiting the invention to a particular embodiment or combination of embodiments. The scope of the invention is defined by the appended claims.

I claim:

1. A steam boiler, comprising:

a boiler housing;

a helical coil disposed within said boiler housing, said helical coil having a feedwater input end for inputting feedwater and an opposite steam output end for outputting steam, said helical coil defining an inner space;

a burner which emits combustion gases into said boiler housing;

a feedwater pump for supplying feedwater to said helical coil;

a heat emitter having a plurality of perforations and an internal cavity, said heat emitter disposed within said inner space of said helical coil between said helical coil and said burner, so that said combustion gases from said burner are received by said internal cavity and pass though said plurality of perforations before contacting said helical coil, said heat emitter not part of said burner;

said burner outputting heated combustion gases into said internal cavity of said heat emitter; and, said heat emitter converting heat in said combustion gases into radiant heat which heats said helical coil.

2. The steam boiler according to claim 1, further including:

said heat emitter having a conical shape.

3. The steam boiler according to claim 2, further including;

said conical shape having a truncated end; and, an unperforated plug disposed at said truncated end, said unperforated plug preventing said combustion gases from exiting said truncated end, and forcing said combustion gases through said plurality of perforations.

4. The steam boiler according to claim 1, further including:

said internal cavity being vacant, so that said combustion gases flow directly from said burner to said heat emitter and then directly to said helical coil.

5. The steam boiler according to claim 1, further including:

said helical coil having a first length; and, said heat emitter having a second length which is greater than said first length of said helical coil.

6. The steam boiler according to claim 1, further including:

said helical coil including a plurality of coil segments;

said plurality of coil segments including a first group of coil segments disposed near said feedwater input end but not near said steam output end, and a second group of coil segments disposed near said steam output end but not near said feedwater input end; and, said first group of coil segments being tightly wound so that they block passage of said combustion gases, and said second set of coil segments being loosely wound so that they facilitate passage of said combustion gases.

7. The steam boiler according to claim 1, further including:

said heat emitter having a conical shape;

said conical shape having a truncated end;

a plug disposed at said truncated end;

said heat emitter having a surface;

said plurality of perforations substantially evenly distributed on said surface of said heat emitter;

said internal cavity being vacant, so that said combustion gases flow directly from said burner to said heat emitter and then directly to said helical coil;

said helical coil having a first length;

said heat emitter having a second length which is greater than said first length of said helical coil;

said helical coil including a plurality of coil segments;

said plurality of coil segments including a first group of coil segments disposed near said feedwater input end, and a second group of coil segments disposed near said steam output end; and, said first group of coil segments being tightly wound so that they block passage of said combustion gases, and said second set of coil segments being loosely wound so that they facilitate passage of said combustion gases.

8. A steam boiler, comprising:

a boiler housing;

a helical coil disposed within said boiler housing, said helical coil having a feedwater input end for inputting feedwater and an opposite steam output end for outputting steam, said helical coil defining an inner space;

a burner which emits combustion gases into said boiler housing;

a feedwater pump for supplying feedwater to said helical coil;

a heat emitter having a plurality of perforations and an internal cavity, said heat emitter disposed within said inner space of said helical coil between said helical coil and said burner, so that said combustion gases from said burner are received by said internal cavity and pass though said plurality of perforations before contacting said helical coil; and, said heat emitter having a conical shape.

9. The steam boiler according to claim 8, further including:

said conical shape having a truncated end; and, an unperforated plug disposed at said truncated end, said unperforated plug preventing said combustion gases from exiting said truncated end, and forcing said combustion gases through said plurality of perforations.

10. A steam boiler, comprising:

a boiler housing;

a helical coil disposed within said boiler housing, said helical coil having a feedwater input end for inputting feedwater and an opposite steam output end for outputting steam, said helical coil defining an inner space;

a burner which emits combustion gases into said boiler housing;

a feedwater pump for supplying feedwater to said helical coil;

a heat emitter having a plurality of perforations and an internal cavity, said heat emitter disposed within said inner space of said helical coil between said helical coil and said burner, so that said combustion gases from said burner are received by said internal cavity and pass though said plurality of perforations before contacting said helical coil;

said helical coil including a plurality of coil segments;

said plurality of coil segments including a first group of coil segments disposed near said feedwater input end but not near said steam output end, and a second group of coil segments disposed near said steam output end but not near said feedwater input end; and, said first group of coil segments being tightly wound so that they block passage of said combustion gases, and said second set of coil segments being loosely wound so that they facilitate passage of said combustion gases.

* * * * *